US010042316B2

(12) United States Patent
Yoshitoku

(10) Patent No.: US 10,042,316 B2
(45) Date of Patent: Aug. 7, 2018

(54) CLEANING BLADE AND IMAGE FORMING APPARATUS

(71) Applicant: CANON KABUSHIKI KAISHA, Tokyo (JP)

(72) Inventor: Daisuke Yoshitoku, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/683,979

(22) Filed: Aug. 23, 2017

(65) Prior Publication Data

US 2018/0059612 A1 Mar. 1, 2018

(30) Foreign Application Priority Data

Sep. 1, 2016 (JP) ..... 2016-171141

(51) Int. Cl.
*G03G 21/00* (2006.01)
*G03G 15/16* (2006.01)

(52) U.S. Cl.
CPC ..... *G03G 21/0029* (2013.01); *G03G 15/168* (2013.01); *G03G 21/0017* (2013.01); *G03G 15/161* (2013.01); *G03G 21/0058* (2013.01); *G03G 2215/1661* (2013.01)

(58) Field of Classification Search
CPC ..... G03G 21/0011; G03G 21/0017; G03G 21/0029; G03G 21/0058; G03G 15/161; G03G 15/168; G03G 2215/1661
USPC ..... 399/350
See application file for complete search history.

(56) References Cited

U.S. PATENT DOCUMENTS

| | | | | |
|---|---|---|---|---|
| 5,450,184 | A | 9/1995 | Yanai et al. | |
| 8,644,753 | B2 | 2/2014 | Ohmori et al. | |
| 9,170,556 | B2 | 10/2015 | Karashima et al. | |
| 9,541,887 | B2 | 1/2017 | Nakajima et al. | |
| 2016/0124375 | A1 | 5/2016 | Nakajima et al. | |
| 2017/0003643 | A1* | 1/2017 | Aoyama | G03G 21/0011 |
| 2017/0199493 | A1* | 7/2017 | Watanabe | G03G 21/0017 |

FOREIGN PATENT DOCUMENTS

| | | | |
|---|---|---|---|
| JP | 4-212190 | A | 8/1992 |
| JP | 2008-122821 | A | 5/2008 |
| JP | 2015-206990 | A | 11/2015 |
| JP | 2016-090619 | A | 5/2016 |

OTHER PUBLICATIONS

Extended European Search Report in European Application No. 17184204.0 (dated Feb. 1, 2018).

* cited by examiner

*Primary Examiner* — Sophia S Chen
(74) *Attorney, Agent, or Firm* — Fitzpatrick, Cella, Harper & Scinto

(57) ABSTRACT

The present disclosure provides a cleaning blade configured to be in contact with a cleaning target member and clean a surface of the cleaning target member. The cleaning blade has a contact surface configured to be in contact with the cleaning target member, and is formed such that (i) Young's modulus of the cleaning blade reaches a peak value at a peak position inside of the contact surface in a thickness direction of the cleaning blade, and (ii) a relationship of Ym>Yc>Yb holds, where Yc is a value of Young's modulus at the contact surface, Ym is the peak value of Young's modulus at the peak position, and Yb is a value of Young's modulus at a position separated from the contact surface more than the peak position in the thickness direction.

13 Claims, 6 Drawing Sheets

CLEANING BLADE AND IMAGE FORMING APPARATUS

BACKGROUND OF THE INVENTION

Field of the Invention

The present invention relates to a cleaning blade configured to be in contact with a cleaning target member and clean a surface thereof, and to an image forming apparatus including the cleaning blade.

Description of the Related Art

A cleaning blade configured to be in contact with a cleaning target member such as a photosensitive drum or an intermediate transfer belt to clean a surface thereof is widely used in a cleaning unit used in an electrophotographic image forming apparatus. The cleaning blade includes a plate-like (blade-like) member configured to come into contact with the cleaning target member at a tip portion thereof and exhibits its cleaning action by blocking adhesive materials such as toner at a contact portion with the cleaning target member.

By the way, when using toner having small particle diameter and high spheroidicity in order to improve image quality and others, a high contact pressure of the cleaning blade is preferred to prevent the toner from slipping through the cleaning blade. However, if the contact pressure is increased, a large frictional force is generated between the cleaning blade and the cleaning target member, and the tip portion of the blade may be dragged and curled by the cleaning target member. Such curling may generate noise caused by vibration of the blade tip portion and may accelerate wear of the cleaning blade.

It is then conceivable to reduce the friction between the cleaning blade and the cleaning target member by arranging such that a surface (contact surface) on a side of the cleaning blade coming in contact with the cleaning target member is harder than an inner layer thereof. Japanese Patent Unexamined Publication No. 2015-206990 discloses a technology of curing a contact surface facing the photosensitive drum of a cleaning blade formed of urethane rubber by using an isocyanurate catalyst. This arrangement reduces friction of the surface of the blade by setting the Young's modulus at the contact surface to be greater than a predetermined value. It is also possible to assure followability of the contact surface to irregularities of the surface of the photosensitive drum by setting such that the Young's modulus drops sharply from the contact surface to the inside of the blade.

However, when using a cleaning blade formed such that the hardness (Young's modulus) drops from the contact surface to the inside as described in the above-described document, there has been a case where wear of the blade occurs locally (referred to as "local abrasion" hereinafter) at the tip portion of the blade. This local abrasion is typically observed as groove-like wear along a rotation direction of the cleaning target member. If such local abrasion occurs, adhesive materials such as toner may slip through a gap formed by the wear, thus possibly causing a defective image.

SUMMARY OF THE INVENTION

The present invention provides a cleaning blade capable of reducing friction and improving durability of a blade surface.

One aspect of the present invention is a cleaning blade configured to be in contact with a cleaning target member and clean a surface of the cleaning target member. The cleaning blade has a contact surface configured to be in contact with the cleaning target member, and is formed such that (i) Young's modulus of the cleaning blade reaches a peak value at a peak position inside of the contact surface in a thickness direction of the cleaning blade, and (ii) a relationship of Ym>Yc>Yb holds, where Yc is a value of Young's modulus at the contact surface, Ym is the peak value of Young's modulus at the peak position, and Yb is a value of Young's modulus at a position separated from the contact surface more than the peak position in the thickness direction.

Further features of the present invention will become apparent from the following description of exemplary embodiments with reference to the attached drawings.

DESCRIPTION OF THE EMBODIMENTS

An image forming apparatus of a present embodiment will be described below. It is noted here that sizes, materials, shapes, relative dispositions and others of components described in the following embodiment are to be modified appropriately depending on a configuration and various conditions of the apparatus to which the present disclosure is applied, and a scope of the present disclosure should not to be limited only to them.

Figure 1:
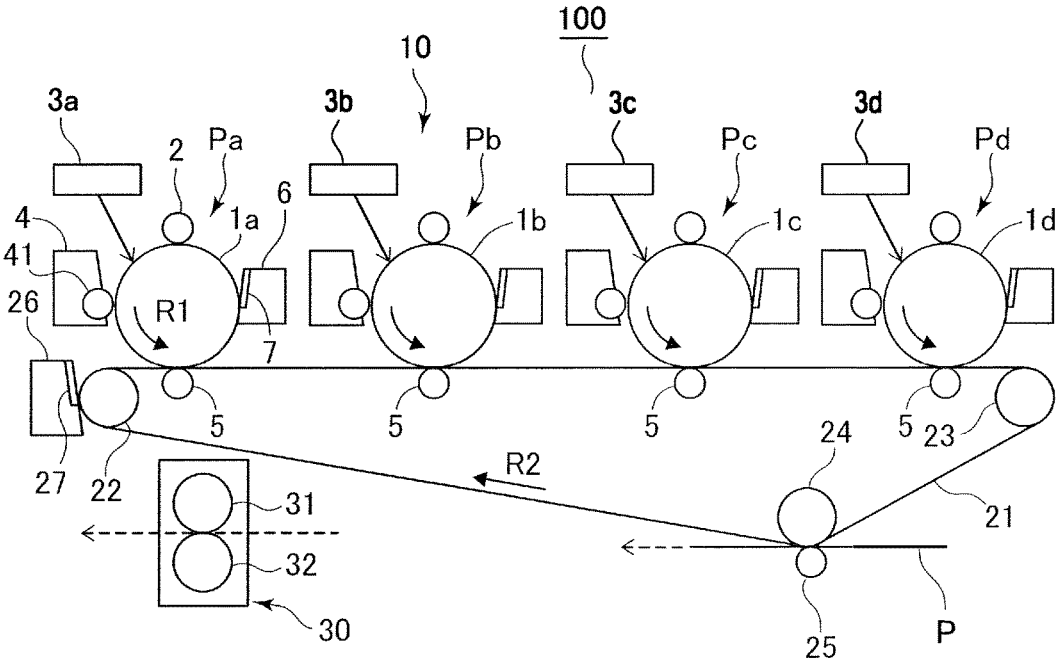
FIG. 1 is a schematic diagram illustrating a configuration of an image forming apparatus of the present disclosure.

As illustrated in FIG. 1, the image forming apparatus 100 of the present disclosure includes a so-called intermediate transfer tandem-type image forming portion 10 including four image forming units Pa, Pb, Pc, and Pd within an apparatus body. The image forming apparatus 100 is configured to form and output an image on a recording medium P based on image information read from a document or inputted from an external device. It is noted that the recording medium P refers to, besides a plain paper, those including a special paper such as a coated paper, those having a special shape such as an envelope and an index paper, and those including a plastic film for an overhead projector, and a cloth.

The image forming units Pa, Pb, Pc, and Pd are electrophotographic type units configured to form toner images of yellow (Y), magenta (M), cyan (C), and black (K), respectively. The respective image forming units Pa through Pd include photosensitive drums 1*a*, 1*b*, 1*c*, and 1*d* serving as electrophotographic photoconductors. The image forming portion 10 also includes exposing units 3*a*, 3*b*, 3*c*, and 3*d* corresponding to the respective photosensitive drums 1*a* through 1*d*.

Each of the photosensitive drums 1*a* through 1*d* has a photosensitive layer of an organic photoconductor (OPC) having a negative charging polarity formed on an aluminum cylinder serving as a conductive substrate, and further has a surface layer composed of a high-hardness material such as acryl. Each of the photosensitive drums 1*a* through 1*d* is 30 mm in outer diameter and 370 mm in length and has the photosensitive layer of 30 μm of thickness, and is driven to rotate in a direction of an arrow R1 in FIG. 1 with a rate of 200 mm/sec for example. It is noted that materials other than the OPC may be used as the photoconductor, and a high-hardness drum such as an amorphous silicon drum may be used for example.

Because the configuration of each of the image forming units Pa through Pd is basically the same other than colors of the stored toners, the following image forming process will be described by exemplifying the yellow image forming unit Pa. In response to a start of the image forming process, the photosensitive drum 1*a* of the image forming unit Pa is driven to rotate. The surface of the photosensitive drum 1*a* is uniformly electrified by an electrification unit 2 and is then exposed by the exposing unit 3*a* to form an electrostatic latent image.

A development unit 4 stores two-component developer, which contains toner of 6 μm of average particle diameter and carrier of 50 μm of average particle diameter, and agitates the developer therein to cause triboelectrification of the toner and the carrier. The electrified toner is adsorbed to a developing sleeve 41, which is an aluminum sleeve serving as a developer bearing member, by a magnetic force generated by a magnet not illustrated. Then, the electrostatic latent image is visualized, i.e., developed, as a toner image by the toner that have moved to the photosensitive drum 1*a* by bias voltage, in which AC voltage is superimposed on DC voltage, applied to the developing sleeve 41.

Toner images of corresponding colors are also formed similarly on the photosensitive drums 1*b* through 1*d* in the image forming units Pb, Pc, and Pd. The toner images formed on the respective photosensitive drums 1*b* through 1*d* are primarily transferred onto the intermediate transfer belt 21 serving as an intermediate transfer member so as to be superimposed on each other by primary transfer units 5 such as transfer rollers. The intermediate transfer belt 21 is an endless belt member wrapped around a driving roller 22, a tension roller 23 and a secondary transfer inner roller 24 and is driven to rotate in a direction of an arrow R2, along which the photosensitive drums 1*a* through 1*d* are rotated. Adhesive materials such as transfer residual toner left on the photosensitive drum 1*a* are removed by a belt cleaning unit 6.

In parallel with such image forming process, a sheet feed portion not illustrated executes an operation of feeding the recording medium P toward the image forming portion 10. The sheet feed portion includes a sheet feed cassette and a feed unit of a retard separation type or a separation pad type, and feeds the recording medium P while separating one by one. The recording medium P fed by the sheet feed portion is delivered to a registration roller portion to undergo correction of a skew thereof and is then conveyed to a secondary transfer unit 25 in synchronism with the advance of the image forming process in the image forming portion 10. The secondary transfer unit 25 includes a transfer roller facing the secondary transfer inner roller 24 for example and performs a secondary transfer process by electrostatically adsorbing the toner image borne on the intermediate transfer belt 21 onto the recording medium P. Transfer residual toner left on the intermediate transfer belt 21 is removed by a belt cleaning unit 26.

The recording medium P onto which the non-fixed toner image has been transferred is passed to a fixing unit 30 and nipped between a roller pair 31, 32 to be heated and pressurized to melt and adhere, i.e., fix, the toner. The recording medium P onto which the image has been fixed is discharged out of the apparatus by a discharge unit not illustrated. In a case where duplex printing is to be carried out, the recording medium P is guided toward a reverse conveyance portion at a branch conveyance portion provided between the fixing unit 30 and the discharge unit and is re-conveyed to the image forming portion 10 in a condition in which a front surface is reversed to a back surface.

Cleaning Device

Next, the cleaning unit 6 configured to clean the photosensitive drums 1*a* through 1*d* will be described. It is noted that, because the cleaning units in the image forming units Pb, Pc, and Pd are configured in the substantially same manner with the cleaning unit 6 of the image forming unit Pa, their description will be omitted here.

The cleaning unit 6 includes a cleaning blade 7 to be disposed in contact with the photosensitive drum 1*a*. Along with the rotation of the photosensitive drum 1*a*, the cleaning blade 7 scrapes adhesive materials such as transfer residual toner adhering on the surface of the photosensitive drum 1*a*. A conveyance screw not illustrated collects the adhesive materials scraped down by the cleaning blade 7 into a collection container.

Figure 2:
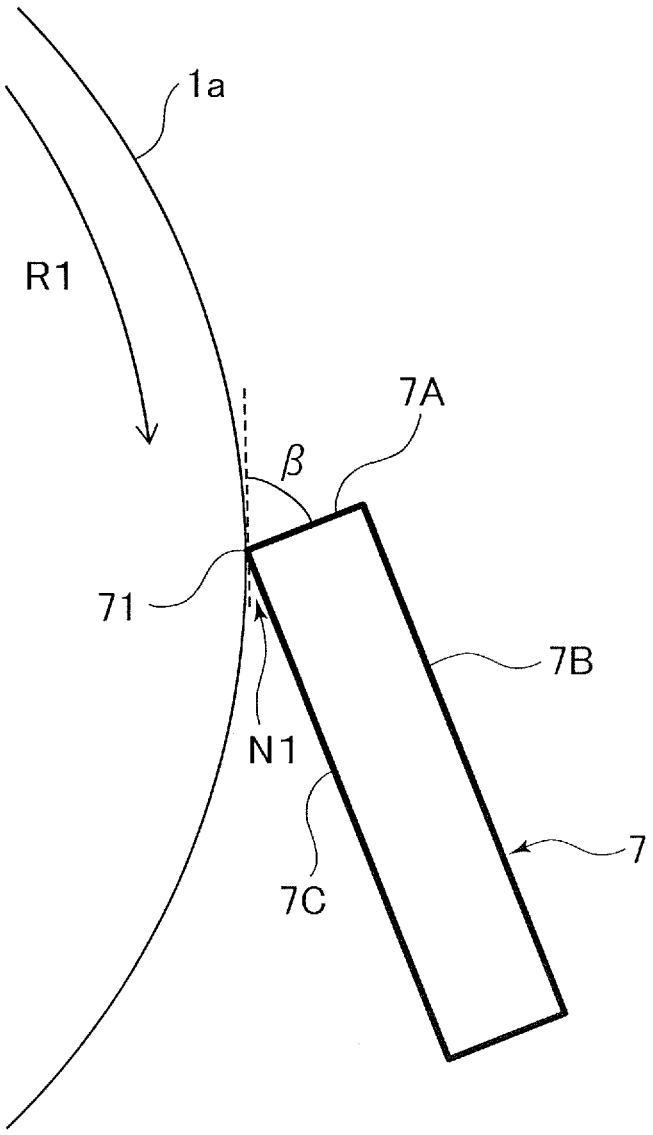
FIG. 2 is a schematic diagram illustrating a disposition of a cleaning blade.

As illustrated in FIG. 2, the cleaning blade 7 is a plate-shape member including a contact surface 7C coming into contact with the photosensitive drum 1*a* on a tip-side area and a back surface 7B on a side opposite from the contact surface 7C. Polyurethane rubber may be suitably used as an elastic material composing the cleaning blade 7 from aspects of elastic force, mechanical strength, ozone resistance, and others. The cleaning blade 7 is disposed to come into contact with the photosensitive drum 1*a* from a counter direction with respect to the rotation direction of the photosensitive drum 1*a*. That is, the cleaning blade 7 extends to a cut surface 7A serving as the tip portion thereof in such that the more the tip portion approaches the rotation axis of the photosensitive drum 1*a*, the more the tip portion extends upstream of the rotation direction of the photosensitive drum 1*a*.

A holding member holding the cleaning blade 7 is turnable centering on an axial line running in parallel with an axial direction of the photosensitive drum 1*a* and is urged by spring members disposed on both sides of the axial direction. This arrangement is set such that the cleaning blade 7 comes into contact with the photosensitive drum 1*a* with a predetermined angle with respect to a tangential direction, indicated by a broken line in FIG. 2, of the drum surface and such that the cut surface 7A is positioned with an adequate cleaning angle β with respect to the tangential direction. Here, an edge portion 71 connecting the cut surface 7A and the contact surface 7C is in pressure contact with the drum surface. Then, the cleaning blade 7 scrapes and removes the adhesive materials such as toner from the drum surface by blocking the adhesive materials at a nip portion N1 formed between the edge portion 71 and the photosensitive drum 1*a*.

Local Abrasion of Cleaning Blade

Here, a Young's modulus profile of the cleaning blade 7, i.e., changes of the Young's modulus with respect to positions in the thickness direction, and relationship between Young's modulus and local abrasion will be described. In general, when using a cleaning blade formed of urethane rubber or other elastic materials, the smaller, i.e., softer, the Young's modulus of such elastic material is, the higher the followability to the irregularity of the cleaning target member such as the photosensitive drum and foreign matters is, but a frictional force acting between the cleaning blade and the cleaning target member tends to increase. If the friction between the cleaning blade and the cleaning target member increases, the cleaning blade may be curled more and causes troubles such as abnormal sound, i.e., a squeaking phenomenon, caused by vibration of the blade tip portion, and acceleration of wear of the cleaning blade. Still further, torque required for driving the photosensitive drum and the intermediate transfer belt, i.e., the cleaning target members, increases.

Conventionally it has been studied to reduce the friction of the blade surface by setting the Young's modulus of the surface layer of the cleaning blade to be higher, i.e., to be harder, as compared to that of an inner layer thereof. For instance, there is known a technique of curing the surface of the cleaning blade facing the cleaning target member, i.e., the contact surface 7C of the present embodiment, by coating a mold for molding the cleaning blade in advance by a catalyst that isocyanurates (trimerizes) isocyanate groups contained in the urethane rubber.

A cleaning blade formed by such method has such a Young's modulus profile that Young's modulus reduces monotonously from a front-surface side to a back-surface side. In this case, because the Young's modulus of the front-surface side is relatively large, the friction with the cleaning target member is reduced and a position of the blade tip portion is maintained while resisting against the frictional force, thereby curling is reduced. Still further, the back-surface side layer having the relatively small Young's modulus backups (supports) the front-surface side layer, permits the blade surface to deform following irregularities of the cleaning target member and reduces slip-through of the toner.

Figure 3A:
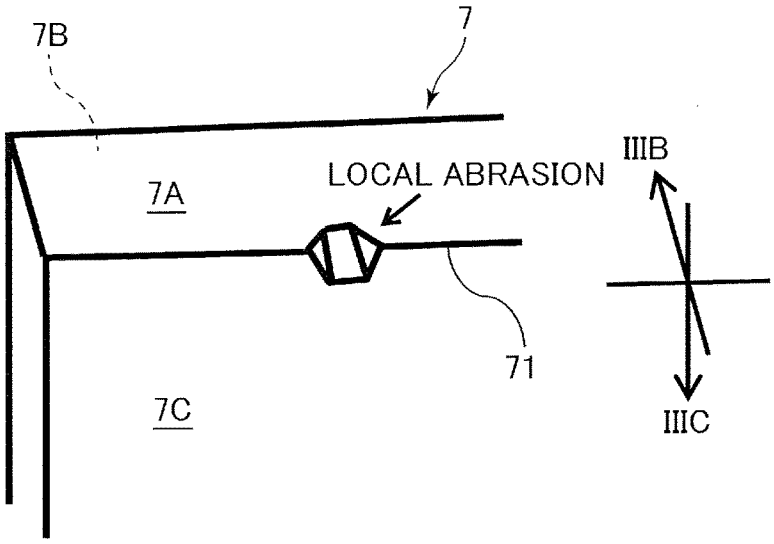
FIG. 3A is a perspective view schematically illustrating the cleaning blade in which a local abrasion has occurred.
Figure 3B:
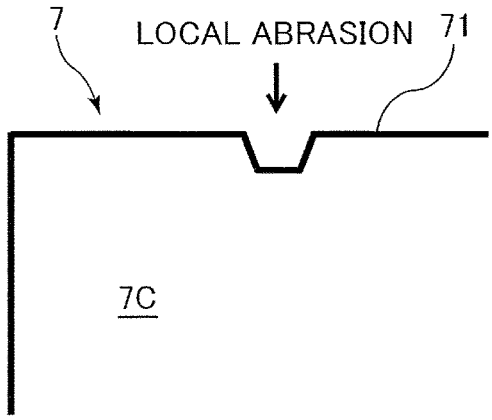
FIG. 3B is a schematic diagram illustrating the cleaning blade in FIG. 3A viewed from one direction (IIIB) indicated in FIG. 3A.
Figure 3C:
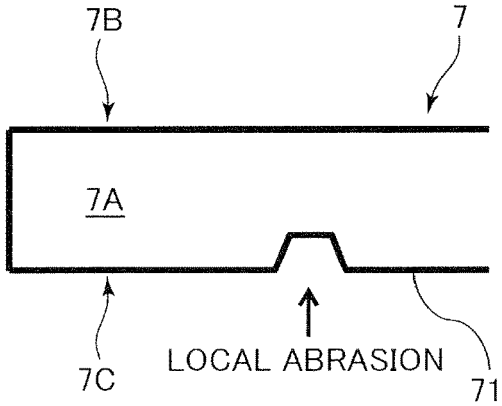
FIG. 3C is a schematic diagram illustrating the cleaning blade in FIG. 3A viewed from another direction (IIIC) indicated in FIG. 3A.

However, as a result of the study, it was found that the edge portion 71 of the cleaning blade 7 may cause a local abrasion at the edge portion 71 of the cleaning blade 7 as illustrated in FIGS. 3A through 3C in the case when the cleaning blade having such Young's modulus profile is used. The local abrasion occurred at random positions in a width direction (right-left direction in FIG. 3A) as a groove-like wear, i.e., a chip, in parallel with the rotation direction of the cleaning target member like the photosensitive drum 1*a*. If such local abrasion occurs, the toner may slip through a gap generated by abrasion, possibly resulting in a defective image.

When adopting the method using isocyanuration described above, a high-contrast Young's modulus profile in which the Young's modulus sharply decreases from the surface side to the back surface side is formed. In this case, a vicinity of the contact surface 7C including the edge portion 71, i.e., an outermost surface layer, has physical property close to plastics from which much of rubber elasticity of polyurethane is lost. Due to that, it is considered that the local chip is liable to occur when a shearing force caused by collision with the irregularities of the cleaning target member or with foreign matters is applied.

Young's Modulus Profile

Figure 4A:
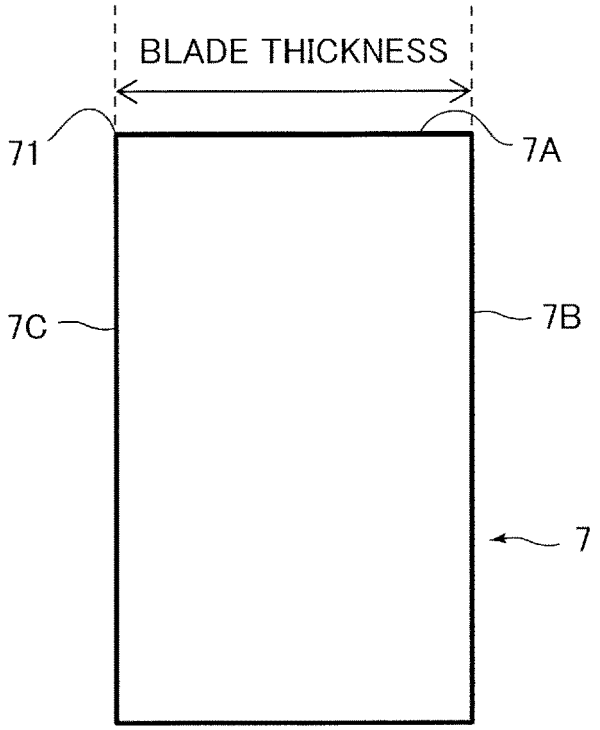
FIG. 4A is a schematic diagram of the cleaning blade viewed from a longitudinal direction thereof.

Based on insights described above, the Young's modulus profile of the cleaning blade 7 in the present embodiment is set such that a peak position of the Young's modulus comes inside of the surface, i.e., the contact surface 7C, facing the cleaning target member. The Young's modulus profile of the cleaning blade 7 of the present embodiment will be described below. It is noted that the thickness direction of the cleaning blade 7 refers to a direction vertical to the contact surface 7C of the cleaning blade 7 in a condition in which the cleaning blade is separated from the cleaning target member, i.e., in a natural state. Still further, the thickness of the blade refers to a distance between the contact surface 7C and the back surface 7B in the thickness direction as illustrated in FIG. 4A.

Figure 4B:
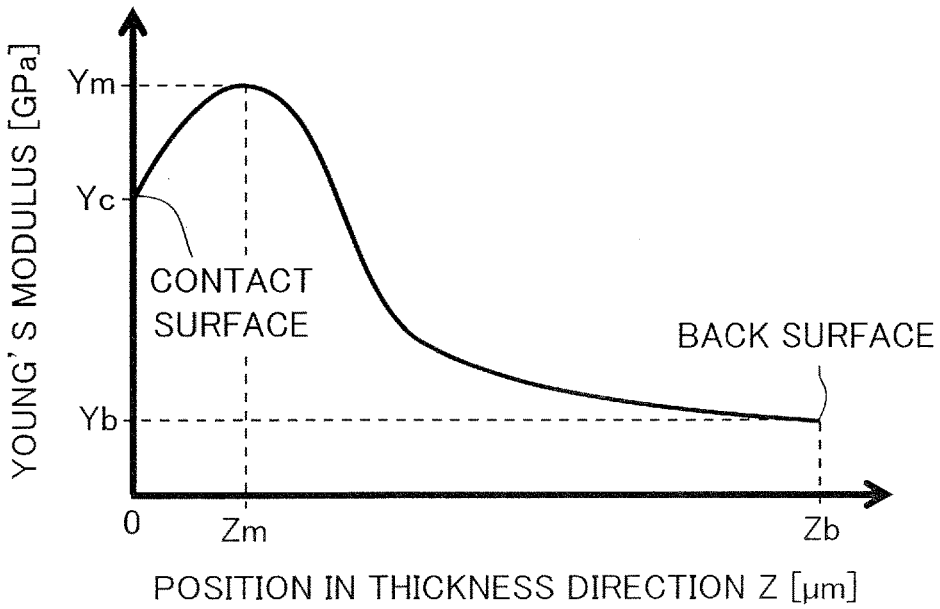
FIG. 4B is a graph representing the Young's modulus profile in terms of a thickness direction of the cleaning blade of the present disclosure.

As illustrated in FIG. 4B, the Young's modulus of the cleaning blade 7 is set such that the Young's modulus reaches a peak value Ym, at an inner position (Z=Zm) inside of the contact surface 7C in the thickness direction. That is, the Young's modulus increases monotonously from the contact surface 7C toward the inner position Zm which is the peak position and decreases monotonously from the inner position Zm toward the back surface 7B (Z=Zb). Here, Zb μm is a thickness of the cleaning blade 7 at the part, i.e., a vicinity of the edge portion 71, to come into contact with the photosensitive drum 1*a*.

A value Yc of the Young's modulus at the contact surface 7C is set to be smaller than the peak value Ym of the Young's modulus. A value Yb of the Young's modulus at the back surface 7B is set to be further smaller than the value Yc of the Young's modulus at the contact surface 7C. Accordingly, a relationship of Ym>Yc>Yb holds among these values Yb, Yc, and Ym.

The value Yc of the Young's modulus at the contact surface 7C is preferable to be 100 MPa or more. This value makes it possible to significantly reduce the friction of the contact surface 7C and to suppress the edge portion 71 from curling. The value Yc is preferable to be 600 MPa or less. This value makes it possible to give adequate elasticity to the outermost layer close to the contact surface 7C and to reduce the occurrence of the local abrasion described above. In other words, even if the irregularities of the cleaning target member and foreign maters adhering on the cleaning target member collide with the edge portion 71 along with the rotation of the cleaning target member, the contact surface 7C can elastically deform and can avoid a local destruction. Still further, because the outermost layer of the blade has the adequate elasticity, the contact surface 7C can follow the irregularities of the surface of the photosensitive drum 1*a* and can reduce toner otherwise slipping-through the contact surface 7C.

The value Yc is preferable to be 200 MPa or more and 400 MPa or less in particular. It is possible to achieve the both effects of reducing the friction of the blade surface and of reducing the local abrasion and the slipping-through toner in high level by setting as described above.

The value Ym of the Young's modulus at the inner position Zm, i.e., the peak position, is preferable to be 400 MPa or more as long as the abovementioned inequality is met. Thereby, the layer around the inner position Zm which is relatively hard supports the outermost layer around the contact surface 7C and can suppress the edge portion 71 of the cleaning blade 7 from being curled. The value Ym is also preferable to be 4000 MPa or less, so that the contact surface 7C appropriately deforms following the irregularities of the surface of the photosensitive drum 1*a*. Still further, this arrangement makes it possible to readily achieve the Young's modulus profile in which the Young's modulus smoothly changes from that of the contact surface 7C to that of the inner position Zm and to prepare the blade containing no boundary surface that may otherwise cause peeling and chipping.

The value Yb of the Young's modulus at the back surface 7B is preferable to be 100 MPa or less as long as the abovementioned inequality is met. This arrangement makes it possible to improve the followability of the contact surface 7C to the irregularities of the surface of the photosensitive drum 1*a* and to improve the cleaning performance.

It is noted that the preferable range of the abovementioned values Yb, Yc, and Ym of the Young's modulus may be replaced as follow by using mgf/μm$^2$ as a unit:

Yc: 10 to 60 mg f/μm$^2$, preferably 20 to 40 mgf/μm$^2$

Ym: 40 to 400 mgf/μm$^2$

Yb: 10 mgf/μm$^2$ or less.

It is preferable to set the inner position Zm, i.e., the peak position of the Young's modulus, within a range of 30 μm or more and 200 μm or less based on the contact surface 7C. The outermost layer of the blade can be fully supported by the relatively hard layer and reducing curling of the cleaning blade 7 can be enhanced by disposing the inner position Zm near the contact surface 7C, i.e., 200 μm or less. The thickness of the layer having the adequate elasticity can be assured and the effect of suppressing the local abrasion can be enhanced by separating the inner position Zm appropriately, i.e., 30 μm or more, from the contact surface 7C.

It is preferable to set the inner position Zm in a range of 50 μm or more and 100 μm or less from the contact surface 7C. This arrangement makes it possible to obtain a highly durable cleaning blade that achieves the both effects of reducing curling of the cleaning blade 7 and of suppressing the local abrasion in high level.

It is also preferable to set the inner position Zm at a position closer to the contact surface 7C more than the back surface 7B in terms of the thickness direction. This arrangement makes it possible to assure the fully thick layer serving as a backup layer on the back surface side of the inner position Zm and to improve the followability of the contact surface 7C to the photosensitive drum 1*a*.

As illustrated in FIG. 4B, it is preferable to configure the cleaning blade 7 such that the Young's modulus sharply decreases from the inner position Zm toward the back surface side. For instance, it is preferable to configure the cleaning blade 7 such that a ratio (Y50/Ym) of the Young's moduli is 0.5 or less, where Y50 is a value of the Young's modulus at a position separated from the inner position Zm to the back surface side by 50 μm, i.e., Z=Zm+50 μm.

This arrangement brings about a condition in which the layer around the relatively hard inner position Zm is backed by a soft layer and makes it possible to improve the followability of the contact surface 7C to the photosensitive drum 1*a* as compared to a configuration in which the Young's modulus decreases moderately on the back surface side of the inner position Zm. Still further, because the back surface side of the inner position Zm is soft, the cleaning blade 7 can take a posture of warping to the back surface 7B side by a relatively small force. Due to that, it is possible to set a cleaning angle β (see FIG. 2) between the cut surface 7A and the tangential direction of the photosensitive drum 1*a* largely more or less as compared to the configuration in which the Young's modulus decreases moderately and to enhance the toner blockability at the nip portion N1.

It is also preferable to set the Young's modulus of the cleaning blade 7 such that the Young's modulus decreases moderately after sharply decreasing from the inner position Zm toward the back surface side. For instance, the Young's modulus may be set based on the inner position Zm such that an average rate of change of the Young's modulus in a range up to 20 μm to the back surface side, i.e., a first average rate of change, is greater than an average rate of change of the Young's modulus in a range up to 20 to 50 μm to the back surface side, i.e., a second average rate of change. In other words, it is preferred to hold the following inequality:

$$\{(Ym-Y20)/20\} \geq \{(Y20-Y50)/30\},$$

where Y20 is a value of the Young's modulus at a position separated from the inner position Zm to the back surface side by 20 μm, i.e., Z=Zm+20 μm.

This arrangement makes it possible to disperse stress between the layer in the vicinity of the inner position Zm which is close to the contact surface 7C and where the stress caused by deformation of the contact surface 7C is large and a layer on the back surface side thereof and to prevent peeling and chipping of the blade otherwise caused by concentration of the stress.

It is noted that the abovementioned numerical values and their magnitude correlations are exemplary configuration of the cleaning blade and may be appropriately changed depending on a material of the cleaning target member and a use environment of the cleaning blade. It is possible to reduce the friction of the cleaning blade while suppressing local abrasion in a case where the relationship represented by the inequality Ym>Yc>Yb holds among the values Yb, Yc, and Ym of the Young's modulus also in such a case. Still further, the Young's modulus profile described above may be achieved at least around the edge portion 71.

Still further, although the present embodiment has been described such that the Young's modulus decreases monotonously in the area of the back surface side than that of the inner position Zm, i.e., the peak position, the same effect with the present embodiment can be brought about as long as the contact surface 7C has the Young's modulus smaller than that of the inner position Zm and the area in which the Young's modulus is smaller than that of the contact surface 7C is assured on the back surface side of the inner position Zm. For instance, even if a protection sheet having a Young's modulus equal to or more than that of the contact surface 7C is pasted on the back surface 7B of the cleaning blade 7, it is possible to achieve the reduction of the friction of the cleaning blade while suppressing the local abrasion. Accordingly, at least the Young's modulus at a predetermined position separated from the contact surface 7C more than the inner position Zm just needs to be set to be smaller than the Young's modulus at the contact surface 7C, i.e., Yc.

Material of Cleaning Blade

The cleaning blade 7 having the Young's modulus profile as described above can be prepared by using urethane rubber for example. The urethane rubber can be synthesized by using polyisocyanate, polyol, a chain extender, e.g., multifunctional polyol, and urethane rubber synthesis catalyst for example. Polyester-based polyurethane rubber can be synthesized by using polyester-based polyol as the polyol, and aliphatic polyester-based polyurethane rubber can be synthesized by using aliphatic polyester-based polyol as the polyol.

It is effective to control a molecular structure of the urethane rubber as a method for increasing the Young's modulus of the blade member formed of the urethane rubber. That is, it is effective to change a degree of cross-linking of the urethane rubber or to control a molecular weight of a raw material of the urethane rubber. In particular, it is preferable to change concentration of isocyanurate groups derived from polyisocyanate, which is the raw material of the urethane rubber, from such an aspect that the Young's modulus can be controlled while suppressing influences to other properties such as mechanical strength and ozone resistance.

The polyisocyanate can be exemplified by the following compounds: 4,4'-diphenylmethane diisocyanate (4,4'-MDI), 2,4-triene diisocyanate (2,4-TDI), 2,6-triene diisocyanate (2,6-TDI), xylene diisocyanate (XDI), 1,5-naphthylene-diisocyanate (1,5-NDI), p-phenylene diisocyanate (PPDI), hexamethylene diisocyanate (HDI), isophorone diisocyanate (IPDI), 4,4'-dicyclohexylmethane diisocyanate (hydrogenated MDI), tetramethylxylene diisocyanate (TMXDI), carbodiimide-modified MDI, polymethylene polyphenyl isocyanate (PAPI). Among these, 4,4'-MDI is preferable in particular.

The high molecular-weight polyol, e.g., aliphatic polyester-base polyol, can be exemplified by the following compounds: ethylene butylene adipate polyester polyol, butylene adipate polyester polyol, hexylene adipate polyester polyol, lactone-based adipate polyester polyol. These compounds may be used solely or in mixture. Among these aliphatic polyester-type polyols, butylene adipate polyester polyol and hexylene adipate polyester polyol are preferable because of their high-crystallinity. A higher crystallinity of the aliphatic polyester-type polyol results in a higher hardness of the polyester-based urethane rubber (the cleaning blade formed of the polyester-based urethane rubber) and higher endurance of the cleaning blade.

The chain extender, e.g., multifunctional low molecular-weight polyol, can be exemplified by glycol. The glycol can be exemplified by the following compounds: ethylene glycol (EG), diethylene glycol (DEG), propylene glycol (PG), dipropylene glycol (DPG), 1,4-butanediol (1,4-BD), 1,6-hexanediol (1,6-HD), 1,4-cyclohexanediol, 1,4-cyclohexanedimethanol, xylene glycol (terephthalyl alcohol), triethylene glycol. As a chain extender other than the glycol, trivalent or higher valent polyhydric alcohol may be used. The trivalent or higher valent polyhydric alcohol is exemplified by trimethylolpropane, glycerin, pentaerythritol, and sorbitol. These compounds may be used solely or in mixture.

Types of the urethane-rubber synthesis catalyst are roughly divided into a urethane-forming catalyst, i.e., a reaction acceleration catalyst that accelerates rubber formation (resin formation) and foaming, and an isocyanurate catalyst, i.e., an isocyanate trimerization catalyst. These compounds may be used solely or in mixture.

The urethane-forming catalyst can be exemplified by the following compounds: tin-based urethane catalysts such as dibutyltin dilaurate and stannous octoate, and amine catalysts such as triethylenediamine, tetramethylguanidine, pentamethyldiethylenetriamine, diethylimidazole, tetramethylpropanediamine and N,N,N'-trimethylaminoethylethanolamine. These compounds may be used solely or in mixture. Among these urethane catalysts, triethylenediamine is preferable in particular from an aspect of accelerating the urethane reaction.

The isocyanurate catalyst can be exemplified by the following compounds: metal oxides such as $Li_2O$, $(Bu_3Sn)_2O$, hydrite compounds such as $NaBH_4$, alkoxide compounds such as $NaOCH_3$, KO-(t-Bu) and borate, amine compounds such as $N(C_2H_5)_3$, $N(CH_3)_2CH_2C_2H_5$ and 1,4-ethylene piperazine (DABCO), alkaline carboxylate salt compounds such as HCOONa, $Na_2CO_3$, PhCOONa/DMF, $CH_3COOK$, $(CH_3COO)_2Ca$, alkaline soap and naphthenic acid salt, an alkali formate compound, and quaternary ammonium salt compounds such as $((R)_3—NR'OH)—OCOR''$. Still further, a combined catalyst, i.e., cocatalyst, used as the isocyanurate catalyst can be exemplified by amine/epoxide, amine/carboxylic acid, amine/alkylene imide. These isocyanurate catalyst and combined catalyst may be used solely or in mixture.

Among the urethane synthesis catalysts, N,N,N'-trimethylaminoethylethanolamine (referred to "ETA" hereinafter) acting solely as the urethane catalyst and exhibiting an action of the isocyanurate catalyst is preferable in particular.

Still further, additives such as a pigment, a plasticizer, a waterproof agent, an antioxidant, ultraviolet absorbing agent, and a light stabilizer may be used together if necessary.

Manufacturing Method of Cleaning Blade

The cleaning blade 7 is formed by the urethane rubber containing the isocyanurate group from an aspect of controllability of the Young's modulus in the following example to which the present embodiment is applied. In this case, a content of the isocyanurate group is increased at the parts where the Young's modulus is large, i.e., at the inner position Zm and its vicinity, as compared to other parts. A manufacturing method of the cleaning blade 7 will be described below.

Process for Obtaining First Composition 299 parts of 4,4'-diphenylmethane diisocyanate and 767.5 parts of butylene adipate polyester polyol having a number-average molecular weight of 2600 were caused to react for three hours at 80° C. to obtain a first composition (prepolymer).

Process for Obtaining Second Composition 0.25 parts of ETAO serving as the urethane-rubber synthesis catalyst was added to 300 parts of hexylene adipate polyester polyol having a number-average molecular weight of 2000, and the resultant mixture was stirred for one hour at 60° C. to obtain a second composition.

Process for Producing Mixture

The first composition was heated to 80° C., the second composition heated to 60° C. was added to the first composition, and these compositions were stirred to obtain a mixture of the first and second compositions. Here, because the first and second compositions are solid in normal temperature and are not fully mixed as they are, their fluidity needs to be enhanced by heating. On the other hand, the higher the temperature, the more the urethane reaction is accelerated, and curing advances before starting a next blade molding process. Then, the abovementioned temperatures (80° C./60° C.) were set as temperatures that suppress the urethane reaction as much as possible while assuring the fluidity required for the mixture.

Blade Molding Process

Figure 5A:
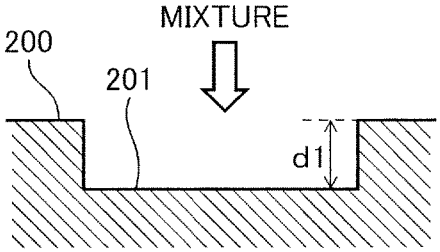
FIG. 5A is a schematic diagram illustrating a first step in a molding process of the cleaning blade.
Figure 5B:
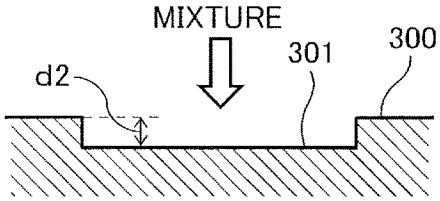
FIG. 5B is a schematic diagram illustrating a second step in the molding process of the cleaning blade.
Figure 5C:
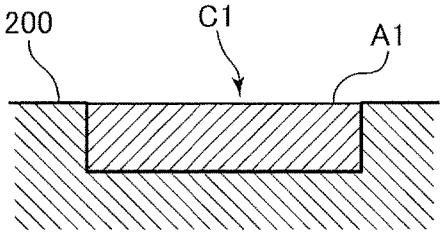
FIG. 5C is a schematic diagram illustrating a third step in the molding process of the cleaning blade.
Figure 5D:
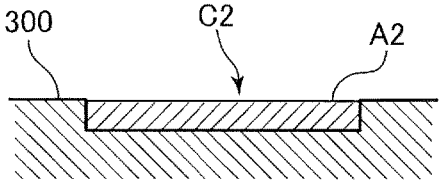
FIG. 5D is a schematic diagram illustrating a fourth step in the molding process of the cleaning blade.
Figure 5E:
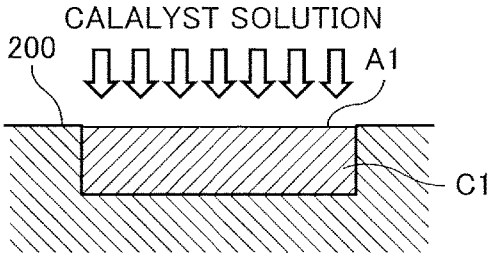
FIG. 5E is a schematic diagram illustrating a fifth step in the molding process of the cleaning blade.

A molding process of the cleaning blade 7 will be described below with reference to FIGS. 5A through 5G. Here, each drawing of FIGS. 5A through 5G is a schematic diagram illustrating each processing step of the blade molding process. At first, after applying a release agent to a surface of a mold 200 as illustrated in FIG. 5A, the abovementioned mixture was injected to a recess portion 201 (depth d1=1.9 mm) of the mold 200 heated to 80° C. as illustrated in FIG. 5C. In the same manner, after applying a releasing agent to a surface of a mold 300 as illustrated in FIG. 5B, the abovementioned mixture was injected to a recess portion 301 (depth d2=0.1 mm) of the mold 300 heated to 80° C. and a part of the mixture flown out of the recess portion 301 was scraped as illustrated in FIG. 5D. Note that it is possible to suppress the urethane reaction as much as possible while assuring the fluidity necessary for mixing the mixtures by heating the molds 200 and 300 in advance to 80° C.

It is noted that the mold 300 having the recess portion 301 as described above or other ordinary thin film forming methods may be used in forming a urethane portion of thickness of d2, e.g., a thin film of d2≤1 mm. While methods of thinning a mixture composition diluted in advance by a solvent by spin coating or screen printing may be exemplified as such methods, the method is not specifically limited as long as such method enables to obtain a film of desirable and uniform thickness. In a case of using the spin coating, a thin film is formed on a metal plate having an approximately equal quality of material with the mold and then the film is heated to a desirable temperature, i.e., 80° C. in the present embodiment, to remove the solvent.

After that, a catalyst solution prepared by mixing 100 parts of the ETA with 100 parts of ethanol was sprayed and coated to a surface A1 of the mixture C1 injected into the mold 200. It is noted that in the case of coating the catalyst solution, a method using a screen mesh, spin coating, slit coating and a method combining these methods may be used other than the spray coating method. That is, the method is not specifically limited as long as the method enables to coat the catalyst solution thinly and uniformly.

Figure 5F:
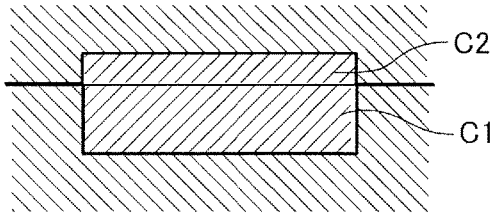
FIG. 5F is a schematic diagram illustrating a sixth step in the molding process of the cleaning blade.
Figure 5G:
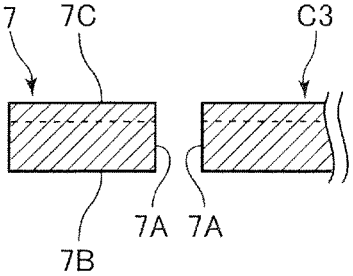
FIG. 5G is a schematic diagram illustrating a seventh step in the molding process of the cleaning blade.

Next, as illustrated in FIG. 5F, the molds were heated to cause a curing reaction in a condition in which the molds 200 and 300 are overlapped such the surface A1 of the mixture C1 held by the mold 200 (FIG. 5E) comes into contact with a surface A2 of the mixture C2 held by the mold 300 (FIG. 5D). After causing the curing reaction by heating the molds at 110° C. for 30 minutes, the mixture was removed from the molds and a urethane rubber plate C3 was obtained as illustrated in FIG. 5G. The urethane rubber plate C3 thus obtained was cut by a cutter to form the edge portion 71. Thus, the cleaning blade 7 of the present embodiment was obtained. The cleaning blade 7 thus obtained was 2 mm thick, 20 mm in length and 345 mm in width.

Here, the mixtures C1 and C2 injected to the molds 200 and 300 held at 80° C. are placed in a condition in which the curing reaction has partially advanced (semi-cured condition) in the stage of pasting their surfaces as illustrated in FIG. 5F. Due to that, if the curing reaction is caused to advance after overlapping the molds 200 and 300, the urethane rubber plate C3 in which urethane linkage is formed at the contact surface of the surfaces A1 and A2 and which is chemically continuously integrated from the contact surface 7C to the back surface 7B is formed. This arrangement makes it possible to obtain the cleaning blade 7 which contains no boundary by which dynamic characteristics such as Young's modulus is discontinuously changed and which hardly causes peeling and chipping. It is noted that a different temperature setting may be used under such condition that the curing reaction is not finished yet at the moment of time of the pasting step.

The ETA contained in the catalyst solution catalyzes the isocyanurate reaction while dispersing in the thickness direction from the contact surface of the surfaces A1 and A2 during the process of the curing reaction. Therefore, more isocyanurate groups are formed in the area closer to the contact surface. Thereby, the Young's modulus profile of the urethane rubber plate C3 thus obtained is what has a peak at the inner position Zm (=100 μm) corresponding to the position of this contact surface.

Note that it is preferable to set the temperature of the mold in the curing reaction step to be 80° C. or more from an aspect of improving a reaction rate. Meanwhile, a higher temperature of the mold results in a smaller difference between the peak value of the Young's modulus and the value of the Young's modulus in areas other than that, i.e., a sharpness of the peak of the Young's modulus profile tends to be decrease. Then, it is preferable to set the temperature to be 150° C. or less. It is more preferable to set the temperature within a range of 100° C. or more and 130° C. or less in order to achieve the both of the reaction rate and an adequate distribution of the Young's modulus.

Figure 6:
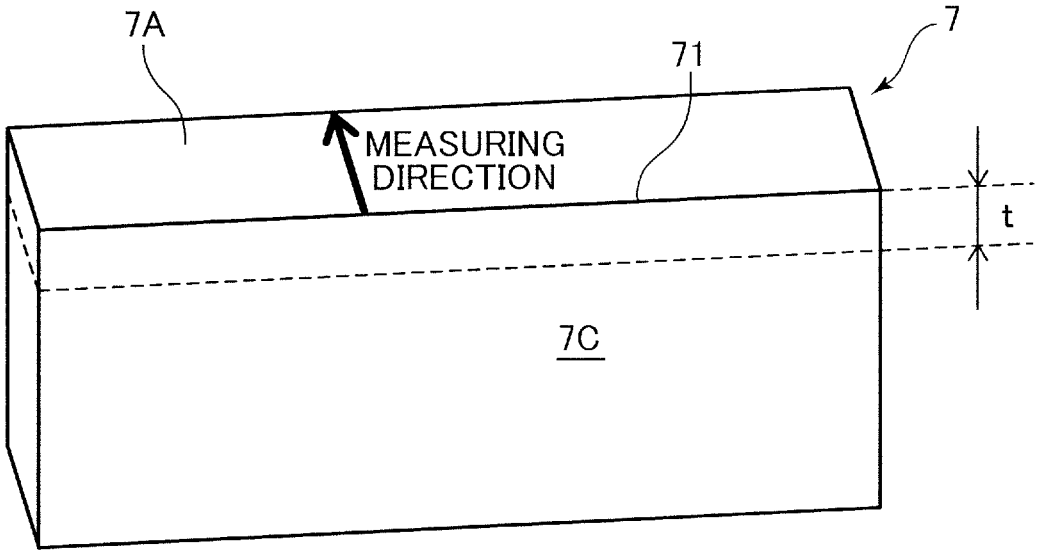
FIG. 6 is a schematic diagram illustrating a method for measuring Young's modulus.

The Young's modulus profile of the cleaning blade thus obtained can be measured by using an ultra-low loaded hardness testing method (a nanoindentation method). The Young's modulus of the cleaning blade 7 of the abovementioned embodiment was measured by using a microindentation hardness tester ENT-1100 (trade name) manufactured by Elionix Inc. As illustrated in FIG. 6, the prepared cleaning blade 7 was cut in parallel with a cut plane 7A such that a thickness t=2 mm. After that, load-unload tests were conducted to the cut plane 7A of the slice under the following conditions at test points arrayed from the contact surface C to the back surface B of the cleaning blade to obtain the Young's modulus as a calculation result of the tester.

Test mode: loading-unloading test
Load range: A
Test load: 100 mgf
Number of steps: 1000 times
Step interval: 10 msec
Load holding time: 2 seconds After conducting the measurements under such conditions, the following results were obtained: Yc=30 mgf/μm$^2$, Ym=400 mgf/μm$^2$, Y20=189 mgf/μm$^2$, Y50=78 mgf/μm$^2$ and Yb=6 mgf/μm$^2$. These measurement results show that the values Yb, Yc, Ym, Y20 and Y50 of the Young's modulus fall within the preferable ranges described above.

The cleaning blade 7 obtained as described above was compared with a cleaning blade to which the arrangement of the present embodiment had not been applied. The comparative cleaning blade used was what has a Young's modulus profile that decreases monotonously from the contact surface 7C to the back surface 7B and what has the similar configuration with that of the cleaning blade 7 of the embodiment other that described above.

In a case where the comparative cleaning blade was used, a stripe image defect that is supposed be caused by the local abrasion of the blade occurred when images of 50,000 sheets were consecutively outputted by the image forming apparatus 100. Meanwhile, in a case where the same number of images was consecutively outputted by using the cleaning blade 7 of the embodiment, no stripe image defect occurred and it was verified that the local abrasion, curling of the blade and cleaning failure are significantly reduced.

OTHER EMBODIMENTS

The cleaning blade 7 used in the cleaning unit 6 of the photosensitive drum 1*a* has been described in the abovementioned embodiment as an exemplary cleaning blade coming into contact with the cleaning target member to clean the surface thereof. It is noted that the cleaning blade 7 of the present embodiment may be used as a cleaning blade for cleaning another cleaning target member, like a cleaning blade 27 of a belt cleaning unit 26 for cleaning the intermediate transfer belt 21. Still further, the use of the cleaning blade 7 is not limited to the image bearing member such as the photoconductor and the intermediate transfer member, and the cleaning blade may be used for cleaning the transfer conveyance belt for example.

Still further, while the cleaning blade 7 that comes into contact with the photosensitive drum 1*a* from the counter direction has been described in the abovementioned embodiment, the present disclosure is also applicable to a cleaning blade disposed in a direction along the rotation direction of the photosensitive drum, i.e., in a trailing direction or in a "with" direction. However, while the cleaning blade 7 disposed along the counter direction as described in the abovementioned embodiment has the enhanced toner blockability, curling of the blade tip portion is liable to be large. Then, the arrangement meeting with the abovementioned Young's modulus profile enables to readily achieve the effects of reducing the friction and the local abrasion of the blade surface.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-171141, filed on Sep. 1, 2016, which is hereby incorporated by reference wherein in its entirety.

What is claimed is:

1. A cleaning blade configured to be in contact with a cleaning target member and clean a surface of the cleaning target member, the cleaning blade comprising a contact surface configured to be in contact with the cleaning target member, wherein the cleaning blade is formed such that:

(i) Young's modulus of the cleaning blade reaches a peak value at a peak position inside of the contact surface in a thickness direction of the cleaning blade, and (ii) Ym>Yc>Yb, where Yc is a value of Young's modulus at the contact surface, Ym is the peak value of Young's modulus at the peak position, and Yb is a value of Young's modulus at a position separated from the contact surface more than the peak position in the thickness direction.

2. The cleaning blade according to claim 1, wherein the Young's modulus Yb is a value of Young's modulus at a surface opposite from the contact surface.

3. The cleaning blade according to claim 1, wherein the Young's modulus Yc is 100 MPa to 600 MPa.

4. The cleaning blade according to claim 1, wherein the Young's modulus Yc is 200 MPa to 400 MPa.

5. The cleaning blade according to claim 1, wherein the Young's modulus Ym is 400 MPa to 4000 MPa.

6. The cleaning blade according to claim 1, wherein the Young's modulus Yb is 100 MPa or less.

7. The cleaning blade according to claim 1, wherein the peak position is located 30 μm to 200 μm from the contact surface in the thickness direction.

8. The cleaning blade according to claim 1, wherein the peak position is located 50 μm to 100 μm from the contact surface in the thickness direction.

9. The cleaning blade according to claim 1, wherein the Young's modulus Yb is a value of Young's modulus on a surface opposite from the contact surface, wherein the peak position is located 50 μm to 100 μm from the contact surface in the thickness direction, wherein the Young's modulus Yc is 200 MPa to 400 MPa, wherein the Young's modulus Ym is 400 MPa to 4000 MPa, and wherein the Young's modulus Yb is 100 MPa or less.

10. The cleaning blade according to claim 1, wherein a ratio (Y50/Ym) of a Young's modulus Y50 to the Young's modulus Ym at the peak position is 0.5 or less, where Y50 is a value of Young's modulus at a position more separated from the contact surface than the peak position toward a side opposite from the contact surface by 50 μm in the thickness direction.

11. The cleaning blade according to claim 10, wherein Ym>Y20>Y50, and wherein a first average rate of change in Young's modulus {(Ym−Y20)/20} is greater than a second average rate of change in Young's modulus {(Y50−Y20)/30}, where Y20 is a value of Young's modulus at a position more separated from the contact surface than the peak position toward the side opposite from the contact surface by 20 μm in the thickness direction.

12. The cleaning blade according to claim 1, wherein a range of the cleaning blade from the contact surface to the position separated from the contact surface more than the peak position in the thickness direction comprises urethane rubber, and the urethane rubber contains an isocyanurate group.

13. An image forming apparatus comprising:

a rotatable image bearing member configured to bear a toner image; and the cleaning blade according to claim 1, the cleaning blade being disposed in contact with the image bearing member from a counter direction and configured to clean a material adhering on the image bearing member.

* * * * *